US009790612B2

(12) United States Patent
Amakusa et al.

(10) Patent No.: US 9,790,612 B2
(45) Date of Patent: Oct. 17, 2017

(54) ANODIZING METHOD OF ALUMINUM

(71) Applicant: DENSO CORPORATION, Kariya, Aichi-pref. (JP)

(72) Inventors: Seiji Amakusa, Kasugai (JP); Tomoya Uchida, Kariya (JP)

(73) Assignee: DENSO CORPORATION, Kariya, Aichi (JP)

( * ) Notice: Subject to any disclaimer, the term of this patent is extended or adjusted under 35 U.S.C. 154(b) by 110 days.

(21) Appl. No.: 14/021,345

(22) Filed: Sep. 9, 2013

(65) Prior Publication Data

US 2014/0069818 A1 Mar. 13, 2014

(30) Foreign Application Priority Data

Sep. 10, 2012 (JP) ..... 2012-198076

(51) Int. Cl.

| | |
|---|---|
| ***C25D 7/04*** | (2006.01) |
| ***C25D 11/04*** | (2006.01) |
| ***C25D 17/12*** | (2006.01) |
| ***C25D 11/00*** | (2006.01) |

(52) U.S. Cl.

CPC ..... *C25D 11/04* (2013.01); *C25D 7/04* (2013.01); *C25D 11/005* (2013.01); *C25D 17/12* (2013.01)

(58) Field of Classification Search

CPC ..... C25D 11/04; C25D 7/04
USPC ..... 205/151
See application file for complete search history.

(56) References Cited

U.S. PATENT DOCUMENTS

| | | | | |
|---|---|---|---|---|
| 902,892 | A * | 11/1908 | Lutz | 205/151 |
| 1,759,171 | A * | 5/1930 | Soderberg | C25D 7/04 204/242 |
| 1,772,074 | A * | 8/1930 | Engelhardt et al. | 205/132 |
| 3,065,153 | A * | 11/1962 | Hough | C25D 5/08 204/230.8 |
| 4,096,042 | A * | 6/1978 | Looney et al. | 205/43 |
| 5,693,210 | A * | 12/1997 | Tomita et al. | 205/324 |
| 8,556,088 | B2 * | 10/2013 | Jeong | 210/500.25 |

(Continued)

FOREIGN PATENT DOCUMENTS

| | | |
|---|---|---|
| JP | 58-045371 | 3/1983 |
| JP | 2007-224369 | 9/2007 |

(Continued)

OTHER PUBLICATIONS

Office Action dated Jul. 8, 2014 in corresponding Japanese Application No. 2012-198076.

*Primary Examiner* — Bryan D. Ripa
(74) *Attorney, Agent, or Firm* — Harness, Dickey & Pierce, P.L.C.

(57) ABSTRACT

In an anodizing method of aluminum, a tubular object made of aluminum or aluminum alloy is located between a pair of cathodes in an electrolysis solution, and a subsidiary cathode is inserted into the tubular object. The tubular object is anodized in the electrolysis solution to form an anodic oxide coating on an inner surface of the tubular object and on an outer surface of the tubular object. Accordingly, the anodic oxide coating can be formed easily not only on the outer surface of the tubular object but also on the inner surface of the tubular object. Therefore, a thickness difference of the anodic oxide coating between on the outer surface of the tubular object and on the inner surface of the tubular object can be reduced.

27 Claims, 8 Drawing Sheets

(56) References Cited

U.S. PATENT DOCUMENTS

| | | | | |
|---|---|---|---|---|
| 2002/0079229 | A1* | 6/2002 | Yoshimura et al. | 205/137 |
| 2004/0256242 | A1* | 12/2004 | Melody et al. | 205/318 |
| 2005/0029114 | A1* | 2/2005 | Tripp et al. | 205/316 |
| 2007/0037677 | A1* | 2/2007 | Splane, Jr. | A63B 21/1492 482/121 |
| 2009/0050485 | A1* | 2/2009 | Wada | C22C 21/00 205/50 |
| 2010/0215541 | A1* | 8/2010 | Spitzl | 422/28 |
| 2010/0320079 | A1* | 12/2010 | Nosti | 204/230.1 |
| 2011/0203933 | A1* | 8/2011 | Amakusa et al. | 205/50 |
| 2012/0037792 | A1* | 2/2012 | Tzeng | B82Y 30/00 250/214 SW |

FOREIGN PATENT DOCUMENTS

| | | |
|---|---|---|
| JP | 2008-202135 | 9/2008 |
| JP | 2010-168642 | 8/2010 |

* cited by examiner

ANODIZING METHOD OF ALUMINUM

CROSS REFERENCE TO RELATED APPLICATION

This application is based on and incorporates herein by reference Japanese Patent Application No. 2012-198076 filed on Sep. 10, 2012.

TECHNICAL FIELD

The present disclosure relates to an anodizing method of aluminum, in which a tubular object made of aluminum or aluminum alloy is anodized in electrolysis solution such that inner and outer surfaces of the tubular object are coated with aluminum oxide.

BACKGROUND

Aluminum products exhibit excellent properties such as lightweight, high workability and good heat conductivity, and aluminum products are thus widely used in the consumer-electronic industry and the motor vehicle industry, for example. The aluminum products are generally used after aluminum oxide coatings are formed on their surfaces by anodizing. The aluminum oxide coatings enhance surface hardness, corrosion resistance, abrasion resistance and colorability of the aluminum products.

An amount of time required in the anodizing of aluminum is desired to be shortened to improve productivity. In order to shorten the required time, generally, electric current density in the anodization is increased. The increase of the electric current density accelerates the forming of the anodic oxide coating, but may increase an amount of heat generation causing dissolution of the formed coating. Patent Document 1 (JP 2010-168642 A corresponding to US 2011/0203933 A1) suggests that conditions, such as ion conductivity in electrolysis solution or a surface temperature of an aluminum object, are controlled to accelerate a forming speed of anodic oxide coating in anodization of the aluminum object. As in Patent Document 1, speeding-up of anodizing of aluminum is desired.

When a tubular object made of aluminum or aluminum alloy is anodized, anodic oxide coating may become different in thickness between on an outer surface and an inner surface of the tubular object. In other words, the anodic oxide coating is more difficult to be thickened on the inner surface of the tubular object than on the outer surface of the tubular object. As a result, the thickness of the anodic oxide coating on the inner surface may become smaller than the thickness of the anodic oxide coating on the outer surface. This thickness difference tends to increase in accordance with a speed of forming of the anodic oxide coating, in other words, the thickness difference tends to increase in accordance with increase of the electric current density.

SUMMARY

It is an objective of the present disclosure to provide a method for anodizing a tubular object made of aluminum or aluminum alloy while a thickness difference of an anodic oxide coating between on an outer surface of the tubular object and on an inner surface of the tubular object can be reduced.

According to an aspect of the present disclosure, there is provided a method for anodizing aluminum. In the anodizing method, a tubular object made of aluminum or aluminum alloy is located between a pair of cathodes in an electrolysis solution, and a subsidiary cathode is inserted into the tubular object. Additionally, the tubular object is anodized in the electrolysis solution to form an anodic oxide coating on an inner surface of the tubular object and on an outer surface of the tubular object.

The tubular object is located between the pair of cathodes in the electrolysis solution, and is anodized. Accordingly, an anodic oxide coating can be formed on a surface of the tubular object. In the above-described anodizing method, the tubular object is anodized in a state where the tubular object is arranged between the pair of the cathode, and the subsidiary cathode is inserted into the tubular object. Accordingly, the anodic oxide coating can be formed easily not only on the outer surface of the tubular object but also on the inner surface of the tubular object. If the tubular object is anodized without the subsidiary cathode, the anodic oxide coating is more difficult to be formed on the inner surface of the tubular object than on the outer surface of the tubular object.

In the above-described anodizing method, the anodic oxide coating can be formed successfully not only on the outer surface of the tubular object but also on the inner surface of the tubular object. Therefore, a thickness difference of the anodic oxide coating between on the outer surface of the tubular object and the inner surface of the tubular object can be reduced. In other words, the anodic oxide coating can be formed to have approximately same thickness on the outer surface and the inner surface of the tubular object.

BRIEF DESCRIPTION OF THE DRAWINGS

The disclosure, together with additional objectives, features and advantages thereof, will be best understood from the following description, the appended claims and the accompanying drawings, in which:

DETAILED DESCRIPTION

Figure 1:
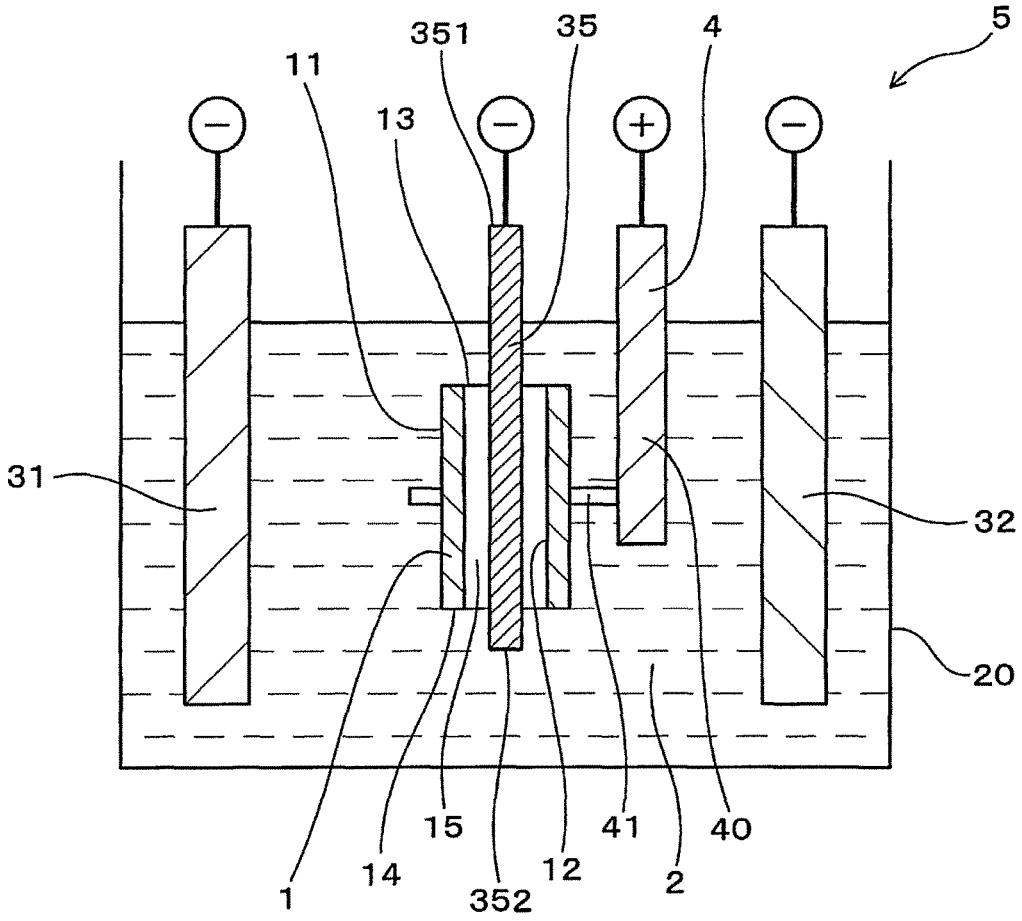
FIG. 1 is a schematic sectional diagram showing an anodization device according to a first practical example of the present disclosure.

An embodiment of the present disclosure will be described below. In an anodizing method of aluminum of the present embodiment, an object made of aluminum or aluminum alloy is anodized in an electrolysis solution. The object that is to be anodized has a tubular shape, and may have a bottom (i.e., closed end) or may not have the bottom. For example, a hollow cylindrical member having an opening on at least one side in its axial direction may be used as the tubular object. The axial direction is perpendicular to a radial direction of a hole of the hollow cylindrical member. The tubular object may be the hollow member having openings on both sides in the axial direction. When one side of the tubular object in the axial direction is closed, the closed end surface of the tubular object may have a through hole communicating with the inner space (i.e., hole) in the tubular object. In this case, electrolysis solution can be easily discharged from the tubular object by the through hole when the tubular object is taken out from the electrolysis solution after anodization. The tubular object that is to be anodized may have a circular cylindrical shape, an ellipsoidal cylindrical shape or a polygonal cylindrical shape, for example. The polygonal cylindrical shape includes a triangular cylindrical shape, a quadrangular cylindrical shape, a pentagonal cylindrical shape, a hexagonal cylindrical shape and an octagonal cylindrical shape.

The tubular object has a tubular shape as a whole. In other words, the shape of the tubular object may not be a perfectly circular cylindrical shape, a perfectly ellipsoidal cylindrical shape, or a perfectly polygonal cylindrical shape. The tubular object may have an inner diameter or/and an outer diameter which varies with location in the axial direction of the tubular object. The tubular object may have a combined shape in which multiple different shapes, such as the circular cylindrical shape, the ellipsoidal cylindrical shape and the polygonal cylindrical shape, are connected in series in the axial direction. The multiple different shapes may be arranged like a gourd as a combined shape of the tubular object. The shape of the tubular object has at least a hole through which a subsidiary cathode can be inserted, and the tubular object is tubular as a whole. For example, the tubular object may be used as a sleeve valve for control of automatic transmission of a vehicle or for control of variable-cam timing.

When the tubular object is anodized, the tubular object is arranged as an anode between a pair of cathodes in the electrolysis solution, and the subsidiary cathode is inserted into the tubular object. Accordingly, a thickness difference of an anodic oxide coating between on an outer surface of the tubular object and an inner surface of the tubular object can be reduced.

A ratio (L/D) of a length L of the tubular object in its axial direction to an inner diameter D of the tubular object may be higher than or equal to 5. In this case, the above-described effect to reduce the thickness difference of the anodic oxide coating between on the outer surface of the tubular object and on the inner surface of the tubular object becomes pronounced. When the tubular object has the ratio L/D higher than or equal to 5 without the subsidiary cathode, the anodic oxide coating is more difficult to be formed on the inner surface of the tubular object than on the outer surface of the tubular object. However, when the subsidiary cathode is inserted into the tubular object having the ratio L/D higher than or equal to 5, the thickness difference of the anodic oxide coating between on the outer surface of the tubular object and on the inner surface of the tubular object can be reduced. Therefore, the above-described effect to reduce the thickness difference of the anodic oxide coating becomes pronounced when the ratio L/D of the tubular object is higher than or equal to 5. The ratio L/D of the tubular object may be higher than or equal to 10 so that the effect to reduce the thickness difference of the anodic oxide coating becomes more pronounced.

When the tubular object has a too large or small size, it may be difficult to insert the subsidiary cathode into the tubular object. Therefore, the size of the tubular object may be defined as following. The ratio L/D of the tubular object may be lower than or equal to 100. Alternatively, the ratio L/D may be lower than or equal to 50, or may be lower than or equal to 30. The inner diameter D of the tubular object may be larger than or equal to 2 millimeters. Alternatively, the inner diameter D of the tubular object may be larger than or equal to 3 millimeters, or may be larger than or equal to 4 millimeters. The length L may be shorter than or equal to 300 millimeters. Alternatively, the length L may be shorter than or equal to 150 millimeters, or may be shorter than or equal to 120 millimeters. When the tubular object has the inner diameter which varies with location in the axial direction of the tubular object, a smallest inner diameter is used as the inner diameter D.

When the tubular object has a perfectly-circular shape in cross-section, the inner diameter of the tubular object is used as the inner diameter D. When the tubular object has an ellipsoidal shape in cross-section, an inner diameter along the minor radius of the ellipsoidal shape is used as the inner diameter D. When the tubular object has an indefinite shape like a circle in cross-section; a diameter of a true circle around a gravity center of the indefinite shape is used as the inner diameter D. The true circle has a center at the gravity center of the indefinite shape, and touches a nearest point of an inner surface of the tubular object to the gravity center. When the tubular object has a polygonal shape in cross-section, a shortest one of straight lines passing through a gravity center of the polygonal shape within the cross-section is used as the inner diameter D. The straight lines connect a vertex and a side of the polygonal shape, or connect two vertices of the polygonal shape, or connect two sides of the polygonal shape. When the tubular object has the inner diameter which varies with location in the axial direction of the tubular object, a smallest inner diameter can be used as the inner diameter D.

In the anodizing method of the present embodiment, an acid aqueous solution may be used as the electrolysis solution. At least one organic acid may be selected for an acid of the acid aqueous solution from among oxalic acid, malonic acid, succinic acid, glutaric acid, maleic acid, itaconic acid, malic acid, tartaric acid and citric acid, for example. When an organic acid is used for the acid of the acid aqueous solution, a free concentration of the organic acid in aqueous solution may be from 20 to 120 g/L. Alternatively, the free concentration of the organic acid may be from 20 to 60 g/L. When two different organic acids are used for the acid of the acid aqueous solution, a total free concentration of the two organic acids in aqueous solution may be from 20 to 120 g/L. Alternatively, the total free concentration may be from 20 to 60 g/L. When oxalic acid is used for the acid of the acid aqueous solution at high concentration and at low temperature, the oxalic acid is easy to precipitate because of low solubility of the oxalic acid in water. High concentration of oxalic acid in the electrolysis solution may lead to load growth in effluent treatment. Therefore, a free concentration of oxalic acid in aqueous solution may be from 20 to 60 g/L.

Alternatively, at least one inorganic acid may be selected for the acid of the acid aqueous solution from among sulfuric acid, phosphoric acid and chromic acid, for example. When an inorganic acid is used for the acid of the acid aqueous solution, a free concentration of the inorganic acid in aqueous solution may be from 100 to 260 g/L. Alternatively, the free concentration of the inorganic acid may be 160 to 200 g/L.

The tubular object is used as an anode in the electrolysis solution. In order to fix the tubular object in the electrolysis solution, a conductive fixing tool may be used. The conductive fixing tool is connected to a positive electrode of an external power. The conductive fixing tool is made to be in contact at least partially with the tubular object by the fixing of the tubular object. Thus, the fixing tool and the tubular object can be connected electrically, and the tubular object can be used as the anode. For example, a chuck may be used as the fixing tool.

A substance made of an acid-resistant metal, such as titanium, or carbon may be used for a material of the fixing tool. For example, one component selected from among acid-resistant metals, such as titanium, and carbon may be used as a major component of the fixing tool. The major component of the fixing tool is a component contained in the fixing tool by not less than 50 wt % (percent by weight) and not more than 100 wt %. A content of the one component selected from among acid-resistant metals and carbon may be more than or equal to 95 wt %, or may be more than or equal to 98 wt %. The fixing tool may be covered with, for example, an insulation resin except for a part of the fixing tool having contact with the tubular object. In this case, for example, copper may be used as the major component of the fixing tool.

In the electrolysis solution, the tubular object is arranged between a pair of cathodes. The cathodes may be made of, for example, conductive material that is corrosion free in the electrolysis solution. For example, the cathodes may be made of at least one material selected from among carbon, titanium, aluminum, lead, stainless steel and tungsten. One material selected from among the above materials may be used as a major component of the cathodes, and the major component of the cathodes is a component contained in the cathodes by not less than 50 wt % and not more than 100 wt %. One material selected from among the above materials may be contained in the cathodes by not less than 95 wt %, or not less than 98 wt %.

The tubular object is anodized in a state where the subsidiary cathode is inserted into the tubular object. The subsidiary cathode is located at least inside the tubular object in the axial direction of the tubular object. The subsidiary cathode may be inserted into the tubular object to extend through the tubular object from one end to the other end of the tubular object in the axial direction. In this case, an end part of the subsidiary cathode in its axial direction protrudes from an opening of an end of the tubular object to be exposed to the exterior of the tubular object. Thus, the subsidiary cathode can be fixed easily because the exposed end part of the subsidiary cathode protrudes to the exterior of the tubular object and is easy to be fixed.

The subsidiary cathode may be inserted into the tubular object and may be arranged inside the both ends of the tubular object in the axial direction of the tubular object. For example, the subsidiary cathode may have a length shorter than the length of the tubular object in its axial direction, and the subsidiary cathode may be arranged inside the both ends of the tubular object in the axial direction. Accordingly, end parts of the subsidiary cathode in an axial direction thereof do not protrude from openings of the both ends of the tubular object. In this case, the thickness of the anodic oxide coating on the inner surface of the tubular object can be further equalized in the axial direction of the tubular object. The anodic oxide coating is easier to be formed on end parts of the inner surface of the tubular object in the axial direction than on a center part of the inner surface in the axial direction. In other words, the anodic oxide coating is easy to be formed near the openings on both ends of the tubular object. When the subsidiary cathode is arranged inside the both ends of the tubular object in the axial direction, a speed of forming of the anodic oxide coating on the inner surface near the openings on the both ends of the tubular object can be moderated. As a result, the anodic oxide coating can be formed to have a more uniform thickness on both the center part and the end parts of the inner surface of the tubular object. The subsidiary cathode may be inserted into the tubular object without having contact with the inner surface of the tubular object. The number of subsidiary cathodes inserted into the tubular object may be one or more than two.

The subsidiary cathode may be made of at least one material selected from among carbon, titanium, aluminum, lead, stainless steel and tungsten, similarly to the pair of cathodes. One material selected from among the above materials may be used as a major component contained in the subsidiary cathode, and the major component of the subsidiary cathode is a component contained in the subsidiary cathode by not less than 50 wt % and not more than100 wt %.

The subsidiary cathode may be made of tungsten. Since the tungsten exhibits excellent characteristics such as high acid resistance and high strength, the subsidiary cathode made of tungsten can be prevented from corroding due to the electrolysis solution and can be prevented from deforming. In order to utilize the excellent characteristics of the tungsten sufficiently, the major component of the subsidiary cathode may be the tungsten, i.e., the tungsten may be contained in the subsidiary cathode by not less than 50 wt % and not more than 100 wt %. The subsidiary cathode may contain the tungsten purely, or may be made of an alloy containing the tungsten as the major component. A content of the tungsten in the subsidiary cathode may be more than or equal to 95 wt %, or may be more than or equal to 98 wt %.

An electric current density applied during anodization may be higher than or equal to 3 $A/dm^2$ (ampere per decimeter). In this case, the above-described effect to decrease the thickness difference of the anodic oxide coating between on the outer surface and the inner surface of the tubular object becomes more pronounced. Additionally, the anodic oxide coating can be formed at relatively high speed. When the electric current density during the anodization is set to be higher than or equal to 3 $A/dm^2$ without the subsidiary cathode inserted, the anodic oxide coating is more difficult to be formed on the inner surface of the tubular object than on the outer surface of the tubular object. By inserting the subsidiary cathode into the tubular object, the anodic oxide coating can be formed to have little difference of thickness between the inner surface and the outer surface of the tubular object even when the electric current density is set to be higher than or equal to 3 A/dm$^2$.

The electric current density may be higher than or equal to 10 A/dm$^2$. In this case, the above-described effect to decrease the thickness difference of the anodic oxide coating between on the outer surface and the inner surface of the tubular object becomes further pronounced, and the anodic oxide coating can be formed at high speed. The electric current density may be higher than or equal to 20 A/dm$^2$, or may be higher than or equal to 50 A/dm$^2$. Since the electrolysis solution is easy to boil at too high electric current density, the electric current density may be lower than or equal to 150 A/dm$^2$.

The electric current density during anodization may be higher than or equal to 20 A/dm$^2$, and the ratio (L/D) of the length L of the tubular object in its axial direction to the inner diameter D of the tubular object may be higher than or equal to 10. In this case, the above-described effect to decrease the thickness difference of the anodic oxide coating between on the outer surface and the inner surface of the tubular object becomes further pronounced, and the anodic oxide coating can be formed at high speed. When the electric current density during the anodization is set to be higher than or equal to 20 A/dm$^2$ and the ratio L/D is higher than or equal to 10 without the subsidiary cathode inserted, the anodic oxide coating can be formed quickly, but the thickness difference of the anodic oxide coating between the outer surface and the inner surface of the tubular object may become extremely large. By inserting the subsidiary cathode into the tubular object, the thickness difference of the anodic oxide coating can be made to be so small even under the above conditions of the electric current density and the ratio L/D. Alternatively, the electric current density during anodization may be higher than or equal to 50 A/dm$^2$, and the ratio (L/D) of the length L of the tubular object in its axial direction to the inner diameter D of the tubular object may be higher than or equal to 10. The electric current density during anodization may be arbitrarily selected from 3 to 150 A/dm$^2$, and the ratio L/D may be arbitrarily selected from 5 to 100.

FIRST PRACTICAL EXAMPLE

A first practical example of the anodizing method of aluminum will be described in reference to drawings. The following practical examples are an example of the present disclosure, and the present disclosure is not limited to the practical examples.

In the first practical example, multiple tubular objects, which are different from each other in a ratio (L/D) of a length L of a tubular object in its axial direction to an inner diameter D of the tubular object, are anodized to be coated with an anodic oxide coating. As shown in FIG. 1, a tubular object 1 made of aluminum alloy is anodized in an electrolysis solution 2. Accordingly, an anodic oxide coating is formed on an outer surface 11 and an inner surface 12 of the tubular object 1. According to the anodizing method of the first practical example, the tubular object 1 is anodized in a state where the tubular object 1 used as an anode is arranged between a pair of cathodes 31 and 32 in the electrolysis solution 2 while a subsidiary cathode 35 is inserted into the tubular object 1.

The anodizing method of the first practical example will be described in detail below. In the first practical example, the tubular object 1 is covered with the anodic oxide coating by using an anodization device 5 shown in FIG. 1. In FIG. 1, an anodization tank 20 is filled with the electrolysis solution 2. The anodization device 5 is provided with a cooling device (not shown) to keep a temperature of the electrolysis solution 2 at a predetermined temperature even when the temperature of the electrolysis solution 2 in the anodization tank 20 increases due to heat generated during anodization. Moreover, the anodization device 5 may be provided with a non-shown pump or a non-shown aeration device in order to circulate the electrolysis solution 2 in the anodization tank 20.

The pair of cathodes 31, 32 is arranged to be away from each other by a predetermined distance in the electrolysis solution 2. The pair of cathodes 31, 32 is made of carbon, and is electrically connected to a negative electrode of an external power.

Figure 2:
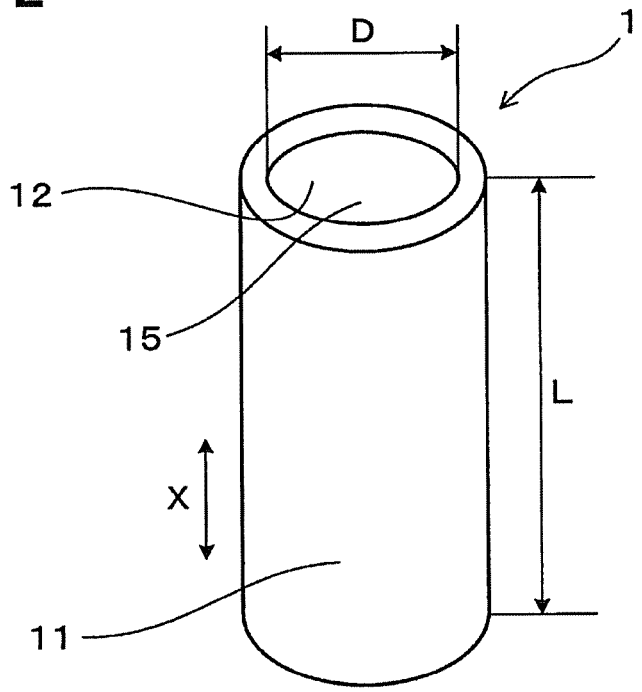
FIG. 2 is a perspective view showing a tubular object that is to be anodized, according to the first practical example.

The tubular object 1 made of aluminum alloy is arranged between the cathodes 31 and 32 in the electrolysis solution 2 without contacting the cathodes 31 and 32. In other words, a clearance is provided between the tubular object 1 and the cathode 31, and another clearance is provided between the tubular object 1 and the cathode 32. The tubular object 1 of the first practical example has a circular cylindrical shape, as shown in FIG. 2, and includes a hole 15 extending in an axial direction X.

Figure 3:
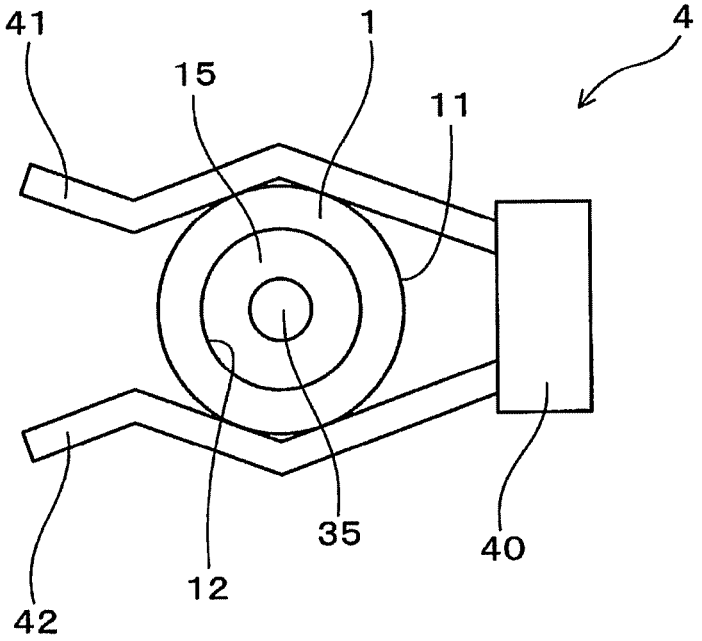
FIG. 3 is a schematic diagram showing a fixing tool holding the tubular object, viewed from above, according to the first practical example.
Figure 11:
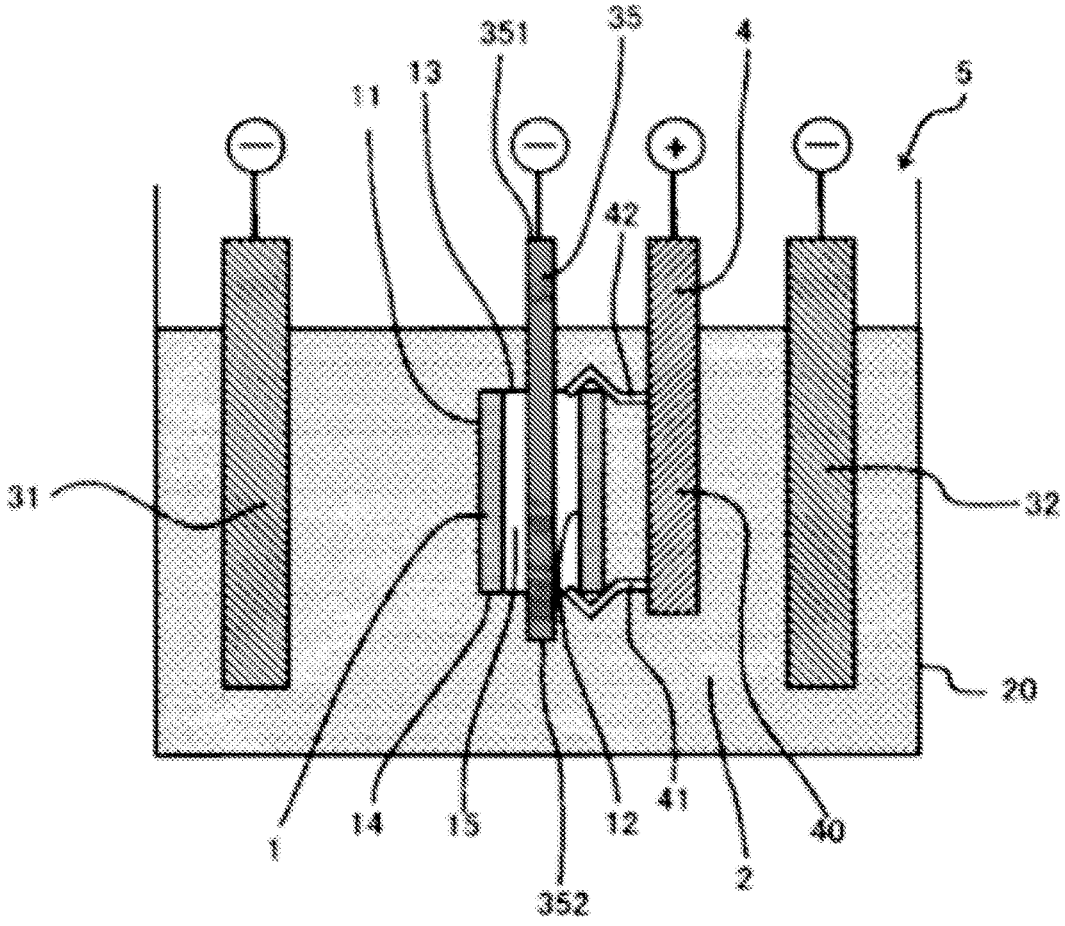
FIG. 11 is a schematic sectional diagram showing an anodizing device according to another embodiment of the present disclosure.

As shown in FIG. 1, the tubular object 1 is arranged in the electrolysis solution 2 such that the axial direction of the tubular object 1 becomes parallel to the vertical direction. A fixing tool 4 may be used to fix the tubular object 1 in the electrolysis solution 2 as shown in FIGS. 1 and 3. In the present example, a chuck is used as the fixing tool 4. The fixing tool 4 of the present example includes a body portion 40 having a rod-like shape, and a pair of holding portions 41 and 42 extending from the body portion 40 in a direction perpendicular to the longitudinal direction of the body portion 40. The pair of holding portions 41 and 42 of the fixing tool 4 holds the tubular object 1 by sandwiching the tubular object 1. The pair of holding portions 41 and 42 is in contact with the outer surface 11 of the tubular object 1 to hold the tubular object 1. In the present example, the body portion 40 and the pair of holding portions 41 and 42 of the body portion 40 are made of titanium. Copper may be used as a material of the body portion 40 when an exposed part of the body portion 40 to the electrolysis solution 2 is covered with resin, for example. The body portion 40 of the fixing tool 4 is electrically connected to a positive electrode of the external power. Since the tubular object 1 is electrically connected to the positive electrode of the external power via the body portion 40 and the pair of holding portions 41 and 42, the tubular object 1 can be used as an anode. The chuck, which fixes the tubular object 1 by sandwiching side surfaces of the tubular object 1, is used as the fixing tool 4 in the present example, but another fixing device having a structure capable of fixing the tubular object 1 in the electrolysis solution 2 may be used as the fixing tool 4 alternatively. For example, both ends of the tubular object 1 in its axial direction may be sandwiched and fixed by urging force of a spring as shown in FIG. 11. In both of these embodiments, the holding positions 41 and 42 and the spring may provide a holding force. Alternatively, the tubular object 1 may be erected on the bottom of the anodization tank 20 to be anodized without using the fixing tool 4.

As shown in FIG. 1, the rod-like subsidiary cathode 35 is inserted into the hole 15 extending in the axial direction of the tubular object 1. In the present example, the subsidiary cathode 35 is inserted into the hole 15 so as to extend completely through the tubular object 1 from one end 13 to the other end 14 of the tubular object 1 in the axial direction of the tubular object 1. Ends 351 and 352 of the subsidiary cathode 35 in its longitudinal direction are protruded from openings of the both ends 13 and 14 of the tubular object 1 such that the ends 351 and 352 are exposed to an exterior of the tubular object 1. The exposed portion of the subsidiary cathode 35 protruded from the opening of the one end 13 is fixed by using a fixing tool (not shown). The subsidiary cathode 35 is inserted into the hole 15 of the tubular object 1 without contacting the inner surface 12 of the tubular object 1. The subsidiary cathode 35 is substantially made of tungsten, and is electrically connected to a negative electrode of the external power.

Figure 4:
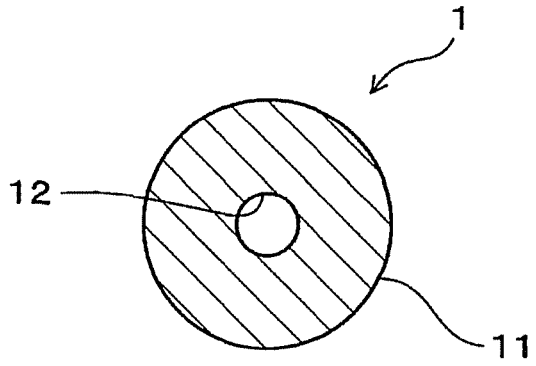
FIG. 4 is a cross-sectional view showing the tubular object after anodization, according to the first practical example.
Figure 5:
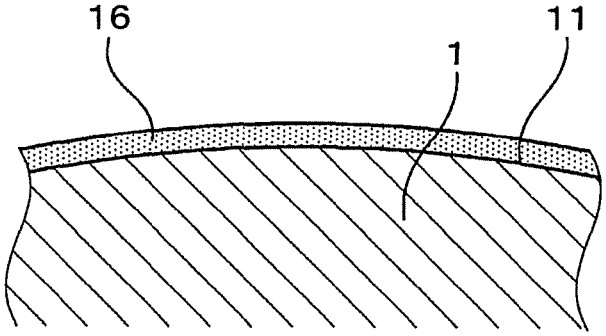
FIG. 5 is a sectional view showing a radially-outer part of the tubular object after anodization, according to the first practical example.
Figure 6:
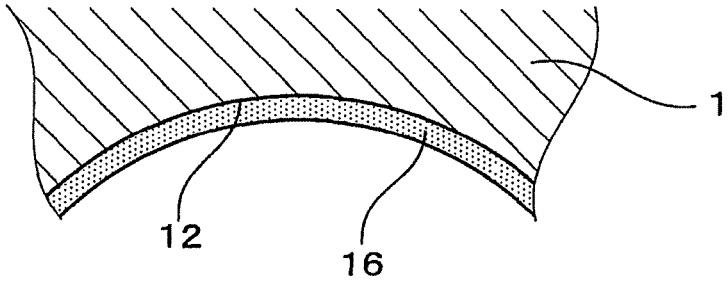
FIG. 6 is a sectional view showing a radially-inner part of the tubular object after anodization, according to the first practical example.

The electrolysis solution is an aqueous solution containing oxalic acid ($(COOH)_2.2H_2O$) at 50 g/L in free concentration. In the present example, anodization is performed under following conditions: a concentration of $Al^{3+}$ in the electrolysis solution 2 is from 0 to 12 g/L; a temperature of the electrolysis solution 2 is 15±2° C.; an electric current density is 60 A/dm$^2$; and a processing time is 20 seconds. As shown in FIGS. 4 to 6, an anodic oxide coating 16 is formed on the outer surface 11 of the tubular object 1 and on the inner surface 12 of the tubular object 1.

In the present example, thirteen kinds of the tubular object 1, which are different from one another in an inner diameter D and a length L (refer to FIG. 2), are anodized. The length L is a length of the tubular object 1 in the axial direction X perpendicular to a radial direction of the tubular object 1. The inner diameter D, the length L, and a ratio of the length L to the inner diameter D of the thirteen tubular objects (Samples 1 to 13) are shown in table 1 below.

TABLE 1

| Sample No. | Inner Diameter [mm] | Length [mm] | Length/Inner Diameter |
|---|---|---|---|
| 1 | 14 | 20 | 1.43 |
| 2 | 12 | 20 | 1.67 |
| 3 | 10 | 20 | 2 |
| 4 | 12 | 60 | 5 |
| 5 | 8 | 40 | 5 |
| 6 | 4 | 20 | 5 |
| 7 | 10 | 60 | 6 |
| 8 | 8 | 60 | 7.5 |
| 9 | 6 | 60 | 10 |
| 10 | 4 | 40 | 10 |
| 11 | 4 | 60 | 15 |
| 12 | 4 | 80 | 20 |
| 13 | 4 | 100 | 25 |

Figure 7:
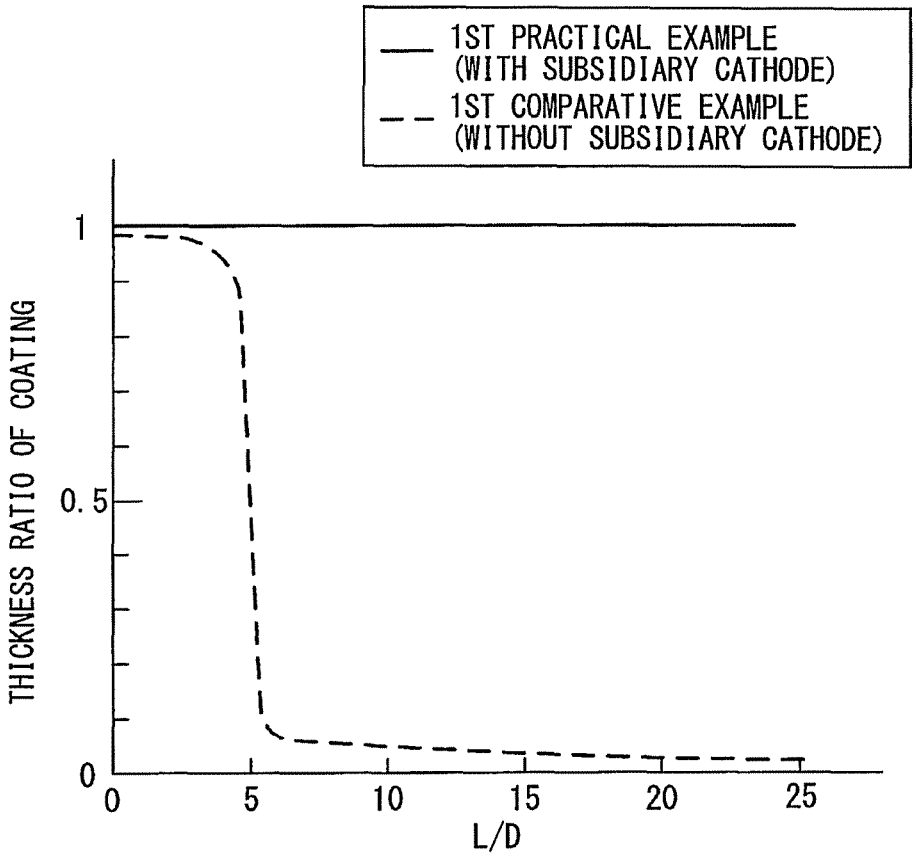
FIG. 7 is a diagram showing a relationship between a thickness ratio of an anodized aluminum oxide coating on an inner surface of the tubular object to that on an outer surface of the tubular object and a ratio of length L to inner diameter D of the tubular object, according to the first practical example and a first comparative example.

Subsequently, thicknesses of the anodic oxide coatings 16 formed on the outer surface 11 and the inner surface 12 of the tubular object 1 (Samples 1 to 13) are measured. The thickness can be measured by using an eddy-current coating thickness meter that is used commonly. However, in the present example, the thickness is measured by microscopic cross-section measurement technique compliant with JIS H 8680-1. In the present example, the thickness of the anodic oxide coating 16 is determined by cross-section observation at 2000-fold magnification at a position corresponding to half the length L in the axial direction X of the tubular object 1 (refer to FIG. 2). FIG. 7 shows a ratio of the thickness (inner surface/outer surface) of the anodic oxide coating 16 on the inner surface 12 of the tubular object 1 to the thickness of the anodic oxide coating 16 on the outer surface 11 of the tubular object 1. The horizontal axis of FIG. 7 shows the ratio (L/D) of the length L of the tubular object 1 to the inner diameter D of the tubular object 1, and the vertical axis of FIG. 7 shows the thickness ratio (inner surface/outer surface) of the anodic oxide coating 16.

FIRST COMPARATIVE EXAMPLE

In a first comparative example, anodization of aluminum is performed without the subsidiary cathode. Conditions of anodization in the first comparative example are the same as those of the above-described first practical example except for non-use of the subsidiary cathode 35. The thirteen samples (Sample No. 1 to 13) described above (refer to Table 1) are used as an object that is to be anodized. Similarly to the first practical example, the ratio of the thickness of an anodic oxide coating (inner surface/outer surface) is obtained and shown in FIG. 7.

Comparison results between the first practical example and the first comparative example will be described. As shown in FIG. 7, when the subsidiary cathode is used in the first practical example, the anodic oxide coating can be formed to have approximately same thickness without having different thickness between on the outer surface of the tubular object and on the inner surface of the tubular object with respect to the all of the tubular objects (Sample No. 1 to 13) which are different in the ratio L/D from one another. When the subsidiary cathode is used, the thickness ratio is equal to approximately 1 as shown in FIG. 7. On the other hand, when the subsidiary cathode is not used in the first comparative example, there is difference in thickness of the anodic oxide coating between on the outer surface of the tubular object and on the inner surface of the tubular object. When the ratio L/D is higher than or equal to 5, the anodic oxide coating is more difficult to be formed on the inner surface of the tubular object than on the outer surface of the tubular object. Thus, in the case without using the subsidiary cathode, the thickness difference may increase, and may further increase when the ratio L/D is higher than or equal to 10.

The results of the first practical example and the first comparative example shown in FIG. 7 indicate that the thickness difference of the anodic oxide coating between on the outer surface 11 and on the inner surface 12 can be reduced by insertion of the subsidiary cathode 35 into the tubular object 1. The insertion of the subsidiary cathode 35 is effective for a case where the ratio L/D is higher than or equal to 5, and is more effective for a case where the ratio L/D is higher than or equal to 10.

SECOND PRACTICAL EXAMPLE

Figure 8:
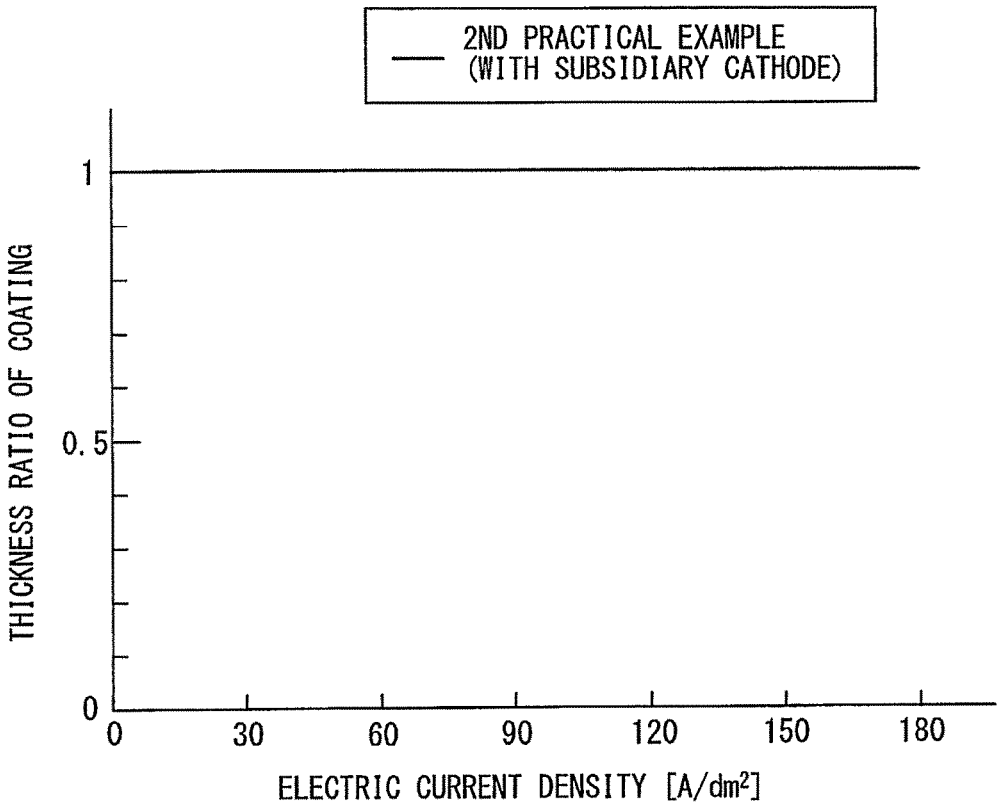
FIG. 8 is a diagram showing a relationship between an electric current density during anodization and a thickness ratio of an anodic oxide coating on an inner surface of a tubular object to that on an outer surface of the tubular object, according to a second practical example of the present disclosure.

In a second practical example, anodization of aluminum is performed by using a subsidiary cathode 35 and varying an electric current density. More specifically, a tubular object 1 to be anodized has a circular cylindrical shape (Outer Diameter: 18 millimeters, Inner Diameter: 4 millimeters, and Length in its axial direction: 60 millimeters). The tubular object 1 is anodized at the electric current density of 0.3 A/dm$^2$, 1 A/dm$^2$, 2 A/dm$^2$, 3 A/dm$^2$, 5 A/dm$^2$, 10 A/dm$^2$, 20 A/dm$^2$, 30 A/dm$^2$, 40 A/dm$^2$, 60 A/dm$^2$, 80 A/dm$^2$, 100 A/dm$^2$, 120 A/dm$^2$, 150 A/dm$^2$, and 180 A/dm$^2$. In the present example, an anodization time period is adjusted so that a product of the anodization time period (seconds) and the electric current density (A/dm$^2$) becomes equal to 1200. The other conditions of the present example are the same as those of the first practical example, and the tubular object 1 is anodized. Similarly to the first practical example, a thickness ratio of an anodic oxide coating 16 between on an outer surface 11 of the tubular object 1 and on an inner surface 12 of the tubular object 1 is obtained and shown in FIG. 8. The horizontal axis of FIG. 8 shows the electric current density [A/dm$^2$], and the vertical axis of FIG. 8 shows the thickness ratio of the anodic oxide coating 16 between on the inner surface 12 of the tubular object 1 and on the outer surface 11 of the tubular object 1 (inner surface/outer surface).

SECOND COMPARATIVE EXAMPLE

In a second comparative example, anodization of aluminum is performed by varying an electric current density without using a subsidiary cathode 35. More specifically, a tubular object 1 to be anodized has a circular cylindrical shape (Outer Diameter: 18 millimeters, Inner Diameter: 4 millimeters, and Length in its axial direction: 60 millimeters). The tubular object 1 is anodized at the electric current density of 0.3 A/dm$^2$, 1 A/dm$^2$, 2 A/dm$^2$, 3 A/dm$^2$, 5 A/dm$^2$, 7 A/dm$^2$, 10 A/dm$^2$, 15 A/dm$^2$, 20 A/dm$^2$, and 25 A/dm$^2$. In the present example, an anodization time period is adjusted so that a product of the anodization time period (seconds) and the electric current density (A/dm$^2$) becomes equal to 1200. The tubular object 1 is anodized without using the subsidiary cathode 35, and the other conditions of the present example are the same as those of the first practical example. Similarly to the first practical example, a thickness ratio of an anodic oxide coating between on an outer surface 11 of the tubular object 1 and on an inner surface 13 of the tubular object 1 is obtained and shown in FIG. 9. The horizontal axis of FIG. 9 shows the electric current density [A/dm$^2$], and the vertical axis of FIG. 9 shows the thickness ratio of the anodic oxide coating between on the inner surface 12 of the tubular object 1 and on the outer surface 11 of the tubular object 1 (inner surface/outer surface).

Comparison results between the second practical example and the second comparative example will be described. As sown in FIG. 8, when the subsidiary cathode 35 is used in the second practical example, the anodic oxide coating can be formed to have uniform thickness without having different thickness between on the outer surface 11 of the tubular object 1 and on the inner surface 12 of the tubular object regardless of the electric current density. On the other hand, as shown in FIG. 9, when the subsidiary cathode 35 is not used in the second comparative example, a difference of thickness of the anodic oxide coating between on the outer surface 11 and on the inner surface 12 increases in accordance with increase of the electric current density. When the electric current density is higher than or equal to 3 A/dm$^2$ in the second comparative example, the anodic oxide coating is more difficult to be formed on the inner surface 12 of the tubular object 1 than on the outer surface 11 of the tubular object 1. Consequently, the thickness difference of the anodic oxide coating between on the inner surface 12 and on the outer surface 11 becomes relatively large in the second comparative example. When the electric current density is higher than or equal to 10 A/dm$^2$, or when the electric current density is higher than or equal to 20 A/dm$^2$, the thickness difference becomes more large. FIG. 9 shows data lower than or equal to 25 A/dm$^2$ in the electric current density. Also in a region of the electric current density more than 25 A/dm$^2$, the thickness ratio (inner surface/outer surface) is confirmed to further decrease in accordance with increase of the electric current density.

Figure 9:
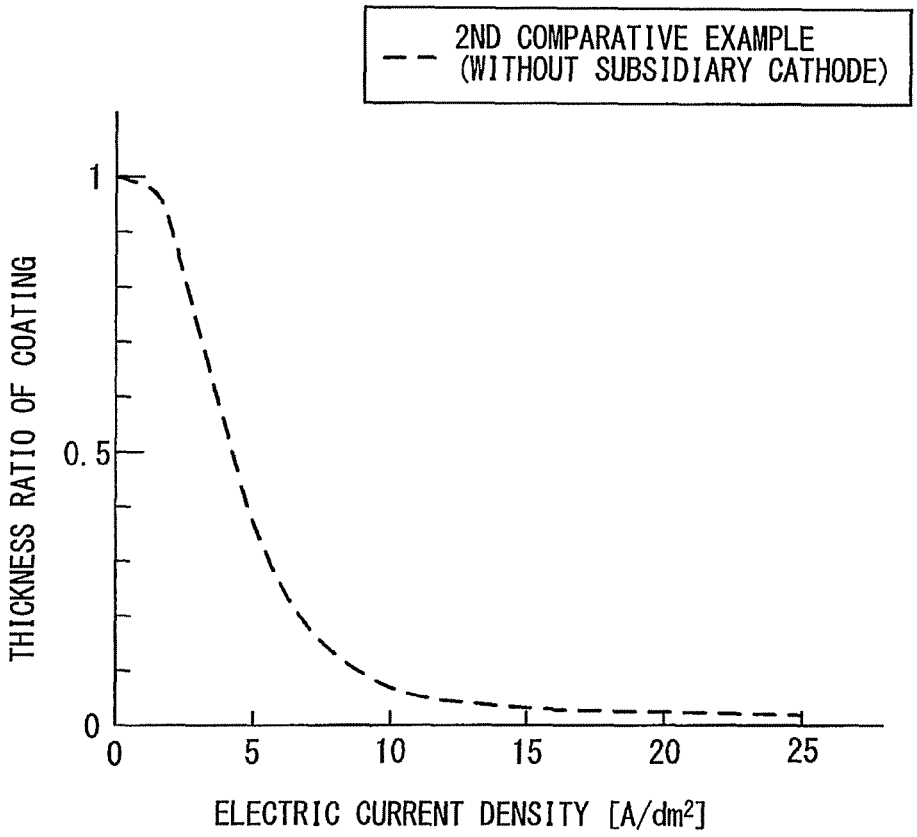
FIG. 9 is a diagram showing a relationship between an electric current density during anodization and the thickness ratio of an anodic oxide coating on an inner surface of a tubular object to that on an outer surface of the tubular object, according to a second comparative example.

According to the results of the second practical example and the second comparative example, shown in FIGS. 8 and 9, the thickness difference of the anodic oxide coating between on the outer surface 11 of the tubular object 1 and on the inner surface 12 of the tubular object 1 can, be reduced by anodizing the tubular object 1 with the subsidiary cathode 35 inserted into the tubular object 1. The insertion of the subsidiary cathode 35 is more effective for reducing the thickness difference when the electric current density is higher than or equal to 3 A/dm$^2$. The insertion of the subsidiary cathode 35 is further effective for reducing the thickness difference when the electric current density is higher than or equal to 10 A/dm$^2$, and when the electric current density is higher than or equal to 20 A/dm$^2$.

THIRD PRACTICAL EXAMPLE

In a third practical example, anodization of aluminum is performed by using a subsidiary cathode 35 and using a sulfuric acid aqueous solution as an electrolysis solution. A tubular object 1 to be anodized has a circular cylindrical shape (Outer Diameter: 18 millimeters, Inner Diameter: 4 millimeters, and Length in its axial direction: 60 millimeters). The electrolysis solution contains sulfuric acid ($H_2SO_4$) at 180 g/L in concentration. In the present example, anodization is preformed under following conditions: a concentration of $Al^{3+}$ in the electrolysis solution is from 3 to 12 g/L; a temperature of the electrolysis solution is 15±2° C.; an electric current density is 60 A/dm$^2$; and a processing time is 20 seconds. The other conditions are the same as those of the first practical example. Similarly to the first practical example, the thickness ratio of an anodic oxide coating between on an outer surface 11 of the tubular object 1 and on an inner surface 12 of the tubular object 1 is measured and calculated. As a result, the thickness ratio of the anodic oxide coating can be made to be equal to approximately 1 in the third practical example, similarly to the first and second practical examples.

THIRD COMPARATIVE EXAMPLE

In a third comparative example, anodization of aluminum is performed by using a sulfuric acid aqueous solution as an electrolysis solution without using a subsidiary cathode 35. A tubular object 1 to be anodized has a circular cylindrical shape (Outer Diameter: 18 millimeters, Inner Diameter: 4 millimeters, and Length in its axial direction: 60 millimeters). The electrolysis solution contains sulfuric acid ($H_2SO_4$) at 180 g/L in concentration. In the present example, anodization is preformed under following conditions: a concentration of $Al^{3+}$ in the electrolysis solution is from 3 to 12 g/L; a temperature of the electrolysis solution is 15±2° C.; an electric current density is 60 A/dm$^2$; and a processing time is 20 seconds. The other conditions are the same as those of the first practical example. Similarly to the first practical example, the thickness ratio of an anodic oxide coating between on an outer surface 11 of the tubular object 1 and on an inner surface 12 of the tubular object 1 is measured and calculated. As a result, the thickness ratio of the anodic oxide coating becomes equal to 0.05.

FOURTH PRACTICAL EXAMPLE

Figure 10:
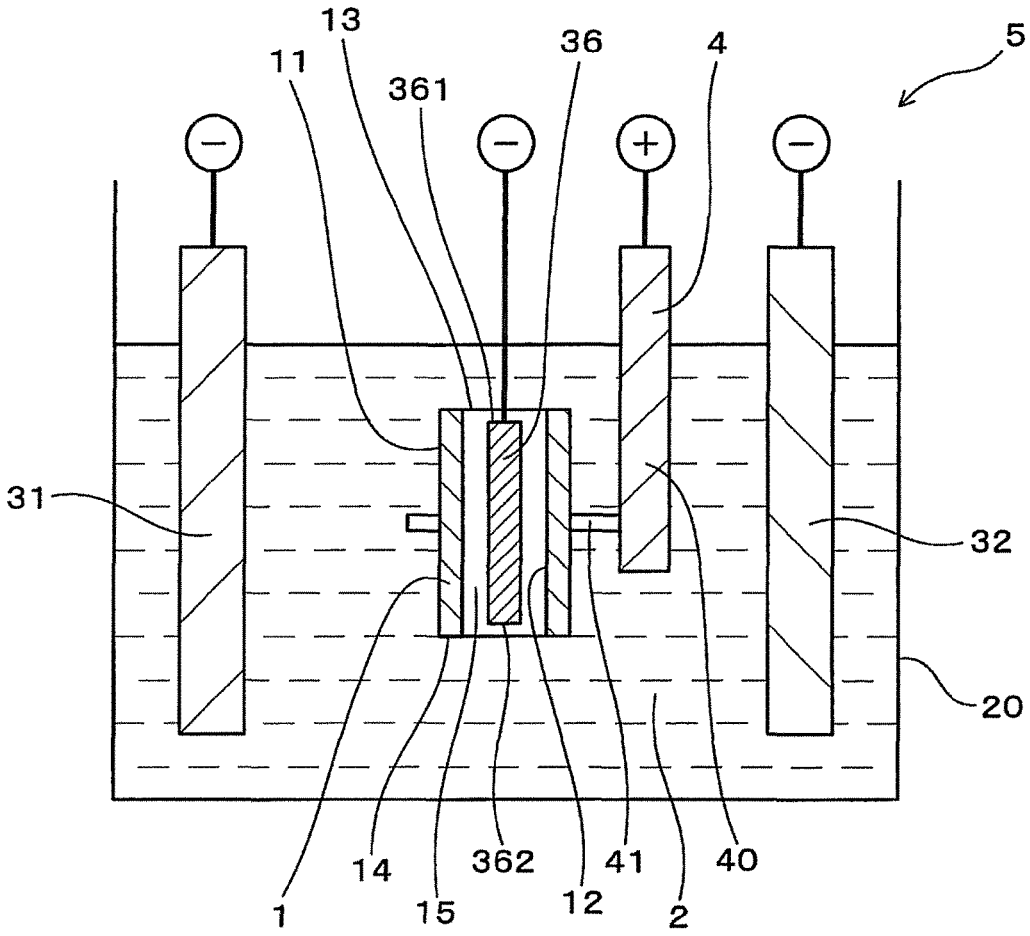
FIG. 10 is a schematic sectional diagram showing an anodization device according to a fourth practical example of the present disclosure.

In a fourth practical example, as shown in FIG. 10, a subsidiary cathode 36 having a rod-like shape is inserted into a tubular object 1, and the subsidiary cathode 36 is arranged inside both end portions 13 and 14 of the tubular object 1 in an axial direction of the tubular object 1. The tubular object 1 has a circular cylindrical shape (Outer Diameter: 18 millimeters, Inner Diameter: 4 millimeters, and Length in its axial direction: 60 millimeters). An electrolysis solution 2 is an aqueous solution containing oxalic acid ($(COOH)_2.2H_2O$) at concentration of 50 g/L. Similarly to the first practical example, anodization of the tubular object 1 is performed under following conditions: concentration of $Al^{3+}$ in the electrolysis solution is from 0 to 12 g/L; a temperature of the electrolysis solution is 15±2° C.; an electric current density is 60 A/dm$^2$; and a processing time is 20 seconds.

As shown in FIG. 10, the subsidiary cathode 36 is inserted into a hole 15 of the tubular object 1, and the hole 15 extends in the axial direction of the tubular object 1. In the present example, the length of the subsidiary cathode 36 in its longitudinal direction is shorter than the length of the tubular object 1 in its axial direction. The subsidiary cathode 36 is arranged inside both end portions 13 and 14 of the tubular object 1 in the axial direction of the tubular object 1. In other words, both ends 361 and 362 of the subsidiary cathode 36 in its longitudinal direction are located inside the both end portions 13 and 14 of the tubular object 1 in the axial direction of the tubular object 1 without protruding from the both end portions 13 and 14 to the exterior of the tubular object 1. An anodization device 5 used in anodization of the tubular object 1 has the same configuration as that of the first practical example except for the above-described subsidiary cathode 36. In FIG. 10, parts assigned the same numerals as parts of FIG. 1 have the same structure as the parts of FIG. 1. Thus, explanations of the parts of FIG. 10 are referred to the preceding examples, and will be omitted arbitrarily in the present example.

Also in the present example, a thickness difference of anodic oxide coatings between on an outer surface 11 of the tubular object 1 and on an inner surface 12 of the tubular object 1 can be reduced. Generally, the anodic oxide coating is easier to be formed on end parts of the inner surface 12 of the tubular object 1 in the axial direction of the tubular object 1 than on a center part of the inner surface 12 in the axial direction of the tubular object 1. In other words, the anodic oxide coating is easy to be formed on the inner surface 12 near the end portions 13 and 14 of the tubular object 1. Since the subsidiary cathode 36 is arranged inside the end portions 13 and 14 in the axial direction of the tubular object 1, a speed of forming of the anodic oxide coating on the inner surface 12 near the end portions 13 and 14 can be reduced and moderated. As a result, the anodic oxide coating can be formed to have uniform thickness both on the center part of the inner surface 12 and on the end parts of the inner surface 12 in the axial direction of the tubular object 1.

Although the present disclosure has been fully described in connection with the preferred embodiments and the practical examples with reference to the accompanying drawings, it is to be noted that various changes and modifications described below will become apparent to those skilled in the art.

In the first to fourth practical examples, the tubular object having the circular cylindrical shape is anodized while the subsidiary cathode is inserted into the tubular object; However, the shape of the tubular object is not limited to the circular cylindrical shape, and the shape of the tubular object may be another tubular shape capable of accommodating the subsidiary cathode therein. Also in this case, effects similar to those of the first to fourth practical examples can be obtained in anodization of the tubular object by inserting, the subsidiary cathode into the tubular object. Thus, for example, the shape of the tubular object may be the above-described circular cylindrical shape, an ellipsoidal cylindrical shape or a polygonal cylindrical shape. Moreover, the outer diameter or the inner diameter of the tubular object may not need to be constant in the axial direction of the tubular object. In other words, the outer diameter or the inner diameter of the tubular object may vary with location in the axial direction of the tubular object. For example, the outer surface of the tubular object or the inner surface of the tubular object may have a step or a slant (i.e., a surface inclined from a plane parallel to the axial direction), in other words, the outer diameter or the inner diameter of the tubular object may partially vary with location in the axial direction. For example, the tubular object having the partially-varied outer diameter or the partially-varied inner diameter may be used as a sleeve valve used for control of an automatic transmission of a vehicle or as a sleeve valve used for control of variable-cam timing of a vehicle. Accordingly, the tubular objects having various shapes can be anodized while the subsidiary cathode is inserted into the tubular objects. Also in this case, similarly to the first to fourth practical examples, the thickness difference of the anodic oxide coating between on the outer surface of the tubular object and on the inner surface of the tubular object can be reduced.

Additional advantages and modifications will readily occur to those skilled in the art. The disclosure in its broader terms is therefore not limited to the specific details, representative apparatus, and illustrative examples shown and described.

What is claimed is:

1. A method for anodizing aluminum, comprising:

locating a tubular object made of aluminum or aluminum alloy between a pair of cathodes in an electrolysis solution;

inserting a subsidiary cathode into the tubular object; and anodizing the tubular object in the electrolysis solution to form an anodic oxide coating on an inner surface of the tubular object and on an outer surface of the tubular object; wherein the step of locating the tubular object includes sandwiching the tubular object on both ends of the tubular object in an axial direction of the tubular object and sandwiching the tubular object directly by a pair of holding portions which are electrically connected to an anode;

an electric current density during the anodization is higher than or equal to 80 A/dm$^2$, and an anodization time period for the anodization is less than or equal to 15 seconds.

2. The anodizing method according to claim 1, wherein the subsidiary cathode is made of tungsten.

3. The anodizing method according to claim 1, wherein the subsidiary cathode extends through the tubular object from one end to the other end of the tubular object in an axial direction of the tubular object.

4. The anodizing method according to claim 1, wherein the subsidiary cathode is located inside both end portions of the tubular object in an axial direction of the tubular object without protruding from the end portions of the tubular object to an exterior of the tubular object.

5. The anodizing method according to claim 1, wherein the anodic oxide coating is a non-conductive coating.

6. The anodizing method according to claim 1, wherein the sandwiching of the tubular object includes using a holding force created by the pair of holding portions.

7. The anodizing method according to claim 1, wherein the tubular object has an ellipsoidal cylindrical shape.

8. The anodizing method according to claim 1, wherein the tubular object has a polygonal cylindrical shape.

9. The anodizing method according to claim 1, wherein the tubular object has a triangular cylindrical shape.

10. The anodizing method according to claim 1, wherein the tubular object has a quadrangular cylindrical shape.

11. The anodizing method according to claim 1, wherein the tubular object has a pentagonal cylindrical shape.

12. The anodizing method according to claim 1, wherein the tubular object has an octagonal cylindrical shape.

13. The anodizing method according to claim 1, wherein the step of inserting the subsidiary cathode into the tubular object locates the entire subsidiary cathode within a bore defined by the tubular object.

14. The anodizing method according to claim 1, wherein
the electric current density during the anodization is higher than or equal to 100 $A/dm^2$, and
the anodization time period for the anodization is less than or equal to 12 seconds.

15. The anodizing method according to claim 1, wherein
the electric current density during the anodization is higher than or equal to 120 $A/dm^2$, and
the anodization time period for the anodization is less than or equal to 10 seconds.

16. The anodizing method according to claim 1, wherein
the electric current density during the anodization is higher than or equal to 150 $A/dm^2$, and
the anodization time period for the anodization is less than or equal to 8 seconds.

17. The anodizing method according to claim 1, wherein
a product of the electric current density and the anodization time period is equal to 1200 $A*sec/dm^2$.

18. The anodizing method according to claim 1, wherein
the electrolysis solution is an aqueous solution including oxalic acid ($(COOH)_2.2H_2O$) at 50 g/L in free concentration.

19. The anodizing method according to claim 1, wherein
a concentration of $Al^{3+}$ in the electrolysis solution is from 0 to 12 g/L.

20. The anodizing method according to claim 1, wherein
a temperature of the electrolysis solution is 15±2° C. during the anodization.

21. The anodizing method according to claim 1, wherein
the pair of holding portions extend perpendicularly from a rod-shaped body portion electrically connected to the anode.

22. The anodizing method according to claim 21, wherein
the pair of holding portions and the body portion are made of titanium.

23. The anodizing method according to claim 21, wherein
the pair of holding portions are made of titanium, and the body portion is made of copper and covered with resin.

24. A method for anodizing aluminum, comprising:
locating a tubular object made of aluminum or aluminum alloy between a pair of cathodes in an electrolysis solution;
inserting a subsidiary cathode into the tubular object; and
anodizing the tubular object in the electrolysis solution to form an anodic oxide coating on an inner surface of the tubular object and on an outer surface of the tubular object; wherein
a ratio of a length of the tubular object in an axial direction of the tubular object to an inner diameter of the tubular object is higher than or equal to 5;
the step of locating the tubular object includes sandwiching the tubular object on both ends of the tubular object in an axial direction of the tubular object and sandwiching the tubular object directly by a pair of holding portions which are electrically connected to an anode;
an electric current density during the anodization is higher than or equal to 80 $A/dm^2$; and
an anodization time period for the anodization is less than or equal to 15 seconds.

25. The anodizing method according to claim 24, wherein the anodic oxide coating is a non-conductive coating.

26. A method for anodizing aluminum, comprising:
locating a tubular object made of aluminum or aluminum alloy between a pair of cathodes in an electrolysis solution;
inserting a subsidiary cathode into the tubular object; and
anodizing the tubular object in the electrolysis solution to form an anodic oxide coating on an inner surface of the tubular object and on an outer surface of the tubular object; wherein
a ratio of a length of the tubular object in an axial direction of the tubular object to an inner diameter of the tubular object is higher than or equal to 10;
the step of locating the tubular object includes sandwiching the tubular object on both ends of the tubular object in an axial direction of the tubular object and sandwiching the tubular object directly by a pair of holding portions which are electrically connected to an anode;
an electric current density during the anodization is higher than or equal to 80 $A/dm^2$; and
an anodization time period for the anodization is less than or equal to 15 seconds.

27. The anodizing method according to claim 26, wherein the anodic oxide coating is a non-conductive coating.

* * * * *